United States Patent [19]

Fernstrom et al.

[11] 4,243,373

[45] Jan. 6, 1981

[54] DIRECT IGNITION GAS BURNER CONTROL SYSTEM

[75] Inventors: Carl F. Fernstrom; Charles D. Visos, both of St. Louis County, Mo.

[73] Assignee: Emerson Electric Co., St. Louis, Mo.

[21] Appl. No.: 28,338

[22] Filed: Apr. 9, 1979

[51] Int. Cl.[3] ..... F23N 5/00

[52] U.S. Cl. ..... 431/66; 431/72; 431/46

[58] Field of Search ..... 431/66, 72, 46, 43, 431/71

[56] References Cited

U.S. PATENT DOCUMENTS

| | | | |
|---|---|---|---|
| 3,620,659 | 11/1971 | Fox | 431/66 |
| 3,672,810 | 6/1972 | Wright et al. | 431/66 |
| 3,676,042 | 7/1972 | Osborne | 431/66 |
| 3,776,684 | 12/1973 | Wright | 431/66 |
| 4,104,016 | 8/1978 | Baysinger | 431/46 X |
| 4,111,640 | 9/1978 | Scott | 431/46 |

*Primary Examiner*—Carroll B. Dority, Jr.
*Assistant Examiner*—Randall L. Green
*Attorney, Agent, or Firm*—Paul A. Becker, Sr.

[57] ABSTRACT

A gas burner control system wherein a burner is directly ignited by an electrical resistance igniter includes a pressure actuated switch effective to permit automatic re-cycle of the system in the event of an electrical power interruption or a gas pressure failure, and to prevent such automatic re-cycle in the event of an ignition failure.

12 Claims, 2 Drawing Figures

DIRECT IGNITION GAS BURNER CONTROL SYSTEM

This invention relates to electrically operated control systems for controlling operation of a main gas burner wherein the burner is directly ignited by an electrical resistance igniter.

For many years, the conventional approach to controlling gas burner operation, particularly in domestic gas fired furnaces, has been to utilize a continuously burning pilot burner flame for igniting the main burner. While such systems are safe and reliable, the continuously burning pilot consumes a considerable amount of gas in the course of time. The heat produced by the pilot contributes essentially nothing to the heating of the dwelling during the heating season, and is entirely wasted during the cooling season.

One approach to eliminating waste of gas by the continuously burning pilot flame is to eliminate the pilot burner and utilize an electrical resistance igniter to directly ignite the main burner. Typical of such systems is that shown in U.S. Pat. No. Re. 25,976. In such a system, a thermostatically actuated device is responsive to igniter temperature and is effective to initiate flow of gas when the igniter is above gas ignition temperature and to concurrently effect de-energizing of the igniter, the mass of the igniter being sufficient to enable the igniter to remain above gas ignition temperature for a short period of time. However, such systems may result in a situation wherein gas flows when the igniter is incapable of igniting the gas. This situation can exist as a result of abnormal operating conditions, such as a failure to ignite or a gas pressure failure, and is due to the response time of the thermostatically actuated device. While such systems have been in use for many years on various appliances, particularly gas fired clothes dryers, the possibility of gas flow with no enabling ignition means presents a problem when attempting to use such system on domestic gas fired furnaces.

Specifically, in clothes dryers, a blower is continuously energized whenever the dryer is operated. This blower is effective, not only to supply heated air to dry the clothes, but also to remove any raw gas which may flow under typical abnormal conditions noted above. While there is a blower or fan in a furnace, it functions to circulate heated air throughout the dwelling and is ineffective to remove unburned gas from the combustion chamber. Thus, in time, unburned gas may accumulate in the combustion chamber posing a potentially hazardous situation. It is noted that while certain lighter-than-air gases, such as natural gas, may eventually rise through the flue if not ignited, there are other fuels, such as liquified petroleum (LP) gas, which are heavier than air and will not safely escape from the combustion chamber.

An object of this invention, therefore, is to provide a generally new and improved electrical control system for a gas burner ignited by an electrical resistance igniter which prevents a hazardous accumulation of unburned gas in the combustion chamber of a domestic gas fired furnace.

A further object is to provide a direct ignition gas burner control system which is effective to prevent flow of gas until the igniter is capable of igniting the gas, and which is effective to lock out if, because of a system malfunction, ignition does not occur within a short period of time.

A further object is to provide a burner control system as in the preceding paragraph which will automatically recycle in the event of flame failure caused by an electrical power interruption or by a gas pressure failure.

A further object is to provide a direct ignition gas burner control system utilizing an electrical resistance igniter wherein a pressure actuated switch is effective to prevent an automatic attempt at re-ignition if ignition does not initially occur, and is effective to prevent a re-institution of gas flow after an electrical power interruption or a gas pressure failure until the igniter is energized sufficiently to ignite the gas.

Yet a further object is to provide a direct ignition gas burner control system utilizing an electrical resistance igniter, which system is safe, reliable, and economical in construction.

Further objects and advantages will appear from the following description when read in conjunction with the accompanying drawings.

In the drawings:

FIG. 1 is a diagrammatic illustration of a burner control system constructed in accordance with the present invention; and FIG. 2 is a cross-sectional view of the gas valve device employed in the control system.

DESCRIPTION OF THE PREFERRED EMBODIMENT

Figure 1:
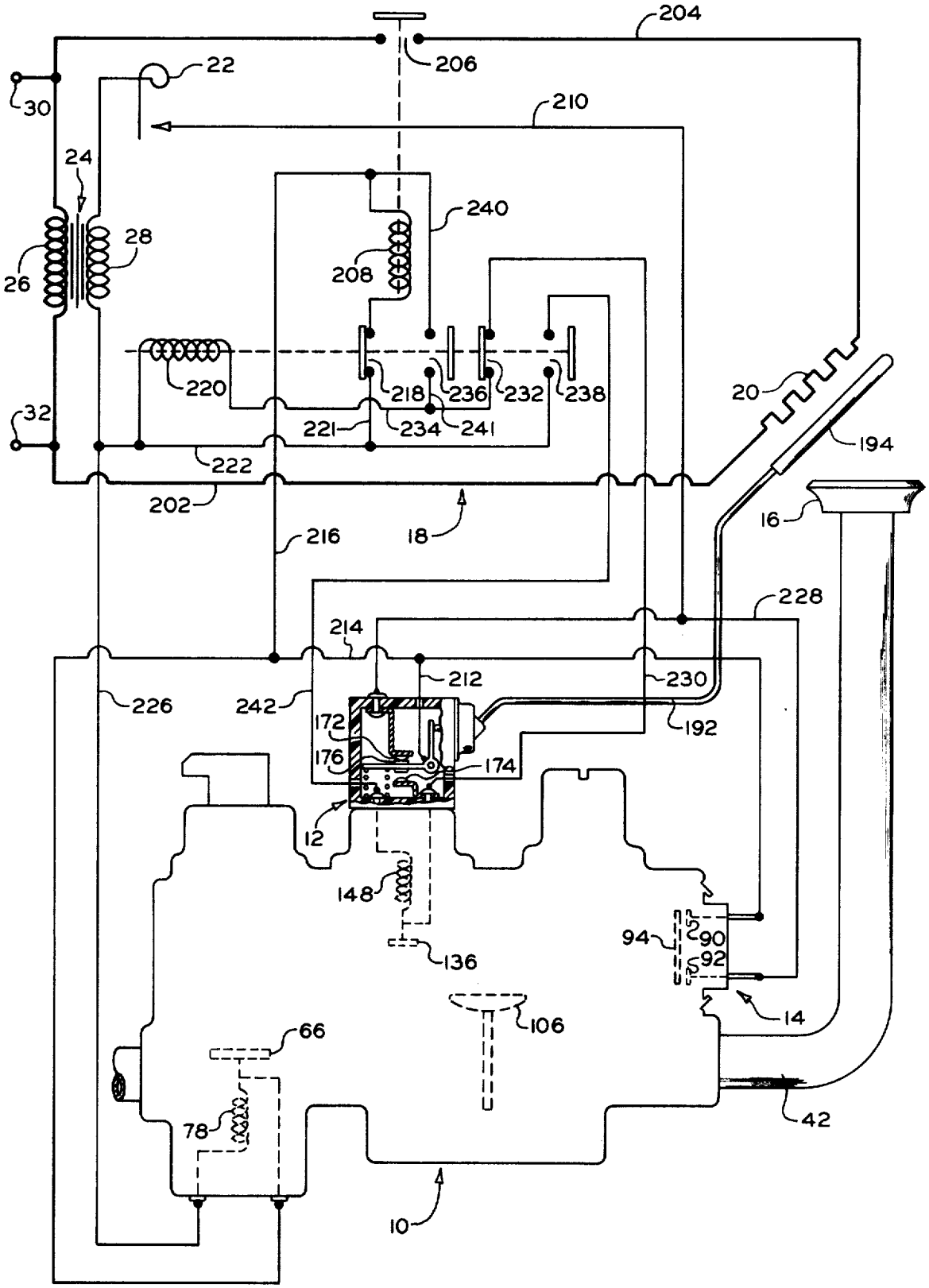

Referring to FIG. 1, the control system includes as primary elements, a manifold gas valve device generally indicated at 10 and including therein a thermostatically actuated switch 12 and a pressure actuated switch 14, a main burner 16, and an electrical control circuit 18. Control circuit 18 includes an electrical resistance igniter 20, a space thermostat 22, and a voltage step down transformer 24 having a primary winding 26 and a secondary winding 28. Primary winding 26 is connected across terminals 30 and 32 of a conventional 120 volt alternating current power source.

DESCRIPTION OF THE MANIFOLD GAS VALVE DEVICE

The manifold gas valve device 10 is similar to that disclosed in U.S. Pat. No. 4,104,016, assigned to the assignee of the present invention.

Figure 2:
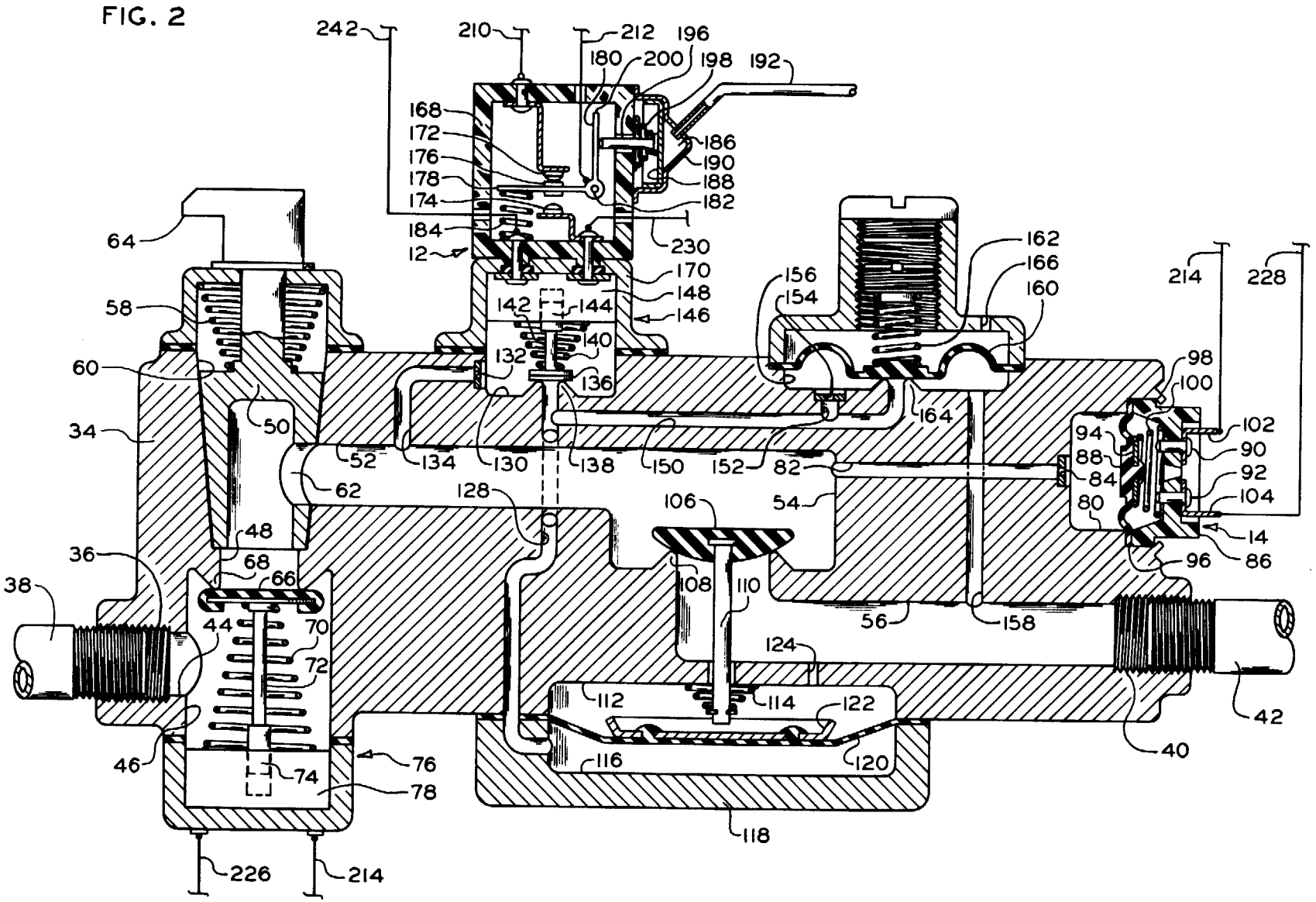

Referring to FIG. 2 of the drawings, the manifold gas valve device 10 comprises a body 34 having an inlet 36 receiving a gas supply conduit 38 from a gas source (not shown), and an outlet 40 receiving a gas conduit 42 leading to the main burner 16 shown in FIG. 1. Connecting inlet 36 and outlet 40 is a main fuel passageway means including an inlet passage 44, a chamber 46, a passage 48, a hollow rotary plug cock 50, a passage 52, a chamber 54, and an outlet passage 56.

Plug cock 50 is biased downwardly by a spring 58 into seating engagement in a vertical tapered bore 60 in body 34 and has a port 62 in the wall thereof which registers with passage 52 when the plug cock 50 is rotated by means of an attached knob 64 to an "on" position.

A biased closed electromagnetically opened primary control valve 66 cooperates with an annular seat 68 formed at the lower end of passage 48 to control all gas flow through the manifold valve device 10. The valve 66 is biased closed on seat 68 by a spring 70 and has a stem 72 connected to the plunger 74 of a solenoid 76 having a winding 78. Valve 66 is opened when winding 78 is energized and is closed by spring 70 when winding 78 is de-energized.

Whenever valve 66 is open and plug cock 50 is in the "on" position wherein port 62 registers with passage 52, gas is supplied via passage 52, and chamber 54 to a diaphragm chamber 80 which operates the pressure actuated switch 14, chamber 80 being in communication with chamber 54 through a passage 82 and an orifice 84. Chamber 80 is formed as a bottom portion of a stepped circular cavity in valve body 34. Secured in a larger diameter top portion of the stepped circular cavity is the pressure actuated switch 14.

Switch 14 comprises a rigid circular cup-shaped member 86 formed of dielectric material, a flexible circular diaphragm member 88 also formed of dielectric material, solid rivet type stationary contacts 90 and 92 secured in spaced relationship in cup member 86, and a movable contact 94 attached to the central portion of diaphragm member 88. Peripheral portions of the cup-shaped member 86 and the diaphragm member 88 are received in the stepped circular cavity with the peripheral portion of the diaphragm member 88 lying against an annular shoulder 96 formed between the bottom and top portions of the cavity and with the peripheral portion of the cup-shaped member 86 overlying the peripheral portion of diaphragm member 88. The peripheral portion of the cup-shaped member 86 is pressed against the diaphragm member 88 and shoulder 96 and held firmly fixed by staking as indicated at 98. The diaphragm member 88 and attached contact 94 are biased away from contacts 90 and 92 by a spring 100. Attached to stationary contacts 90 and 92 and extending outwardly therefrom are connector terminals 102 and 104, respectively.

A valve 106 cooperates with an annular valve seat 108 formed in chamber 54 for controlling gas flow to outlet passage 56 and main burner 16. Valve 106 has a stem 110 extending downwardly into an upper diaphragm chamber 112 formed as a recess in valve body 34, and a spring 114 biases valve 106 downwardly to a closed position on its seat 108. A lower diaphragm chamber 116 is formed by a cup-shaped member 118 attached by any suitable means to valve body 34. A flexible diaphragm 120 is clamped at its periphery between body 34 and member 118 and forms a flexible wall between upper and lower diaphragm chambers 112 and 116 respectively. A relatively rigid disc 122 is centrally positioned and attached to diaphragm 120 and is effective to engage the lower end of the valve stem 110 and move valve 106 upwardly toward an open position when sufficient gas pressure is applied to the lower side of diaphragm 120.

The upper diaphragm chamber 112 is adequately vented to outlet passage 56 through a vent 124 so that the upper side of diaphragm 120 is constantly exposed to the pressure existing in outlet passage 56. The lower diaphragm chamber 116 communicates with inlet passage 44 through a passage 128, a valve chamber 130, an orifice 132, a passage 134, passage 52, port 62, plug cock 50, passage 48, and chamber 46. A biased closed electromagnetically opened valve 136 cooperates with an annular valve seat 138 formed around the entrance of passage 128 into valve chamber 130 to control the admission of inlet gas to the lower diaphragm chamber 116. Valve 136 is baised closed on seat 138 by a spring 140 and has a stem 142 connected to the plunger 144 of a solenoid 146 having a winding 148. Valve 136 is opened when winding 148 is energized and is closed by spring 140 when winding 148 is de-energized.

The gas pressure in the lower diaphragm chamber 116 which is applied to the lower side of diaphragm 120 is always something less than the supply pressure at inlet 36 due to the orifice 132 and because of a constant and a variable bleed-off means between the passage 128 and outlet passage 56 through branch passage means. The branch passage means comprises passages 150 and 152, an orifice 154, a valve chamber 156, and a passage 158. The variable bleed-off means, which varies the bleed-off rate through passage 150 in response to outlet pressure variations so as to maintain some predetermined outlet pressure, comprises a diaphragm type pressure regulator valve 160 biased by an adjustable spring 162 toward a closed position on an annular seat 164 formed around the entrance of passage 150 into valve chamber 156. The side of valve 160 opposite that facing chamber 156 is exposed to atmospheric pressure through a vent 166.

The constant bleed-off means, which bypasses the pressure regulator valve 160 and provides a function to be later described, comprises passages 150 and 152, orifice 154, chamber 156, and passage 158.

Thermostatically actuated switch 12 comprises a casing 168 which, for convenience of illustration, is shown mounted on a housing member 170 of solenoid 146. A pair of stationary contacts 172 and 174 in switch 12 cooperate with a double-headed movable contact 176 to complete and break circuits to be hereinafter described. The movable contact 176 is mounted on one leg 178 of an L-shaped switch blade 180 pivoted on a pin 182, leg 178 extending between stationary contacts 172 and 174 to enable alternate engagement of movable contact 176 with stationary contacts 172 and 174. A spring 184 biases movable contact 176 against stationary contact 172 when switch 12 is in a "cold" position.

An expansible chamber 186 is defined by an inner flexible metal cup 188 and an outer rigid metal cup 190, cup 190 being attached to switch casing 168. Chamber 186 is connected by a capillary tube 192 to a bulb 194, shown in FIG. 1, mounted between igniter 20 and burner 16. The expansible chamber 186, capillary tube 192, and bulb 194 comprise a sealed system filled with a thermally expansible fluid, such as mercury, with bulb 194 positioned so as to be responsive to the heat from igniter 20 and so as to be impinged by the burner flame.

An actuator rod 196 is biased at one end by a spring 198 against the inner flexible cup 188 and at its other end bears against the other leg 200 of the L-shaped switch blade 180. Upon expansion of the expansible chamber 186, actuator rod 196 causes pivoted switch blade 180 to pivot counter-clockwise about pin 182, causing movable contact 176 to break from stationary contact 172 and make with stationary contact 174. When this switching is completed, switch 12 is in a "hot" position.

DESCRIPTION OF THE ELECTRICAL CONTROL CIRCUIT

Referring to FIG. 1 of the drawings, electrical resistance igniter 20 is connected by a lead 202 to power source terminal 32 and by a lead 204 and normally-open contacts 206 of a first relay having a winding 208 to the other power source terminal 30. Relay winding 208 is connected across secondary winding 28 of transformer 24 through thermostat 22, a lead 210, a stationary contact 172 and movable contact 176 of thermostatically actuated switch 12 when switch 12 is in its "cold"

position shown, a lead 212, a lead 214, a lead 216, relay winding 208, a first set of normally-closed contacts 218 of a second relay having a winding 220, a lead 211, and a lead 222. It should be noted that, although igniter 20 is preferably of a type adapted to be energized by 120 volts, igniters capable of being energized by a lower voltage, such as 24 volts, can also be employed. With such a lower voltage igniter, the igniter would be connected where relay winding 208 is connected, and relay winding 208 and its controlled contacts 206 would be omitted.

Solenoid winding 78, which controls valve 66, shown in FIG. 2, is connected across secondary winding 28 through thermostat 22, lead 210, "cold" contact 172 and movable contact 176 of switch 12, leads 212 and 214, solenoid winding 78, and a lead 226. As will be later described, when valve 66 is open, gas pressure effects the connection of stationary contacts 90 and 92 by movable contact 94 in pressure actuated switch 14. When contacts 90 and 92 are connected by movable contact 94, a circuit is provided in parallel with contacts 172 and 176 of switch 12 and lead 212, the circuit being a lead 228, contacts 92, 94, and 90 of pressure actuated switch 14, and lead 214. This circuit provides a hold-in circuit for solenoid winding 78 after contacts 172 and 176 in switch 12 are disconnected and provides other functions to be hereinafter described.

When thermostatically actuated switch 12 is in its "hot" position, wherein contacts 172 and 176 are open and contacts 174 and 176 are closed, relay winding 220 is energized through a circuit as follows: from one side of secondary winding 28, through thermostat 22, leads 210 and 228, contacts 92, 94, and 90 of pressure actuated switch 14, leads 214 and 212, contacts 176 and 174 of switch 12, a lead 230, a second set of normally-closed contacts 232 controlled by relay winding 220, a lead 234, a relay winding 220, and lead 222 to the other side of secondary winding 28. This circuit enables relay winding 220 to be energized, effecting the opening of normally-closed contacts 218 and 232 and the closing of first and second sets of normally-open contacts 236 and 238, respectively.

Relay contacts 236 are adjusted to close before relay contacts 232 open, so that relay winding 220 remains energized when relay contacts 232 open, the circuit being from one side of secondary winding 28, through thermostat 22, leads 210 and 228, contacts 92, 94, and 90 of pressure actuated switch 14, leads 214 and 216, a lead 240, the first set of normally-open, now closed, relay contacts 236, a lead 241, lead 234, relay winding 220, and lead 222 to the other side of secondary winding 28. Thus, the holding circuit for relay winding 220 through contacts 236 is independent of switch 12.

The opening of the first set of normally-closed contacts 218 effects de-energizing of relay winding 208. With relay winding 208 de-energized, its controlled contacts 206 open, causing de-energizing of igniter 20.

The closing of the second set of normally-open contacts 238 effects the energizing of solenoid winding 148, which controls valve 136, shown in FIG. 2, and which enables gas to flow to main burner 16 as will be hereinafter described. The energizing circuit for solenoid winding 148 is as follows: from one side of secondary winding 28, through thermostat 22, leads 210 and 228, contacts 92, 94, and 90 of pressure actuated switch 14, leads 214 and 212, contacts 176 and 174 of switch 12, solenoid winding 148, a lead 242, relay contacts 238, and lead 222 to the other side of the secondary winding 28.

OPERATION OF THE SYSTEM

The gas valve device 10 is shown in FIG. 2 with electromagnetically operated valves 66 and 136 closed, with pressure operated valve 106 closed, with thermostatically actuated switch 12 in its "cold" position, with contacts 90 and 92 disconnected from contact 94 in pressure actuated switch 14, and with plug cock 50 rotated to its "on" position. Under these conditions, no gas is flowing to burner 16 and igniter 20 is de-energized.

When thermostat 22 closes, a solenoid winding 78 is energized by secondary winding 28 through thermostat 22, leads 210, contacts 172 and 176 of switch 12, leads 212, 214, and 226. Energizing of winding 78 causes valve 66 to open, allowing gas to flow through passage 82 and orifice 84 into chamber 80 of pressure actuated switch 14, causing diaphragm member 88 to move outwardly and effect the connection of contacts 90 and 92 by movable contact 94. The connection of contacts 90 and 92 provides a circuit in parallel with contacts 172 and 176 of switch 12 and lead 212.

Also energized by secondary winding 28 when thermostat 22 closes is relay winding 208 which controls energizing of igniter 20, the circuit being completed through thermostat 22, lead 210, contacts 172 and 176 of switch 12, leads 212, 214, and 216, relay winding 208, normally-closed relay contacts 218, and leads 221 and 222. With relay winding 208 energized, its controlled contacts 206 close, causing igniter 20 to be connected across power source terminals 30 and 32 through leads 202 and 204, and relay contacts 206. Electrical resistance igniter 20 begins to heat and the heat radiates to bulb 194.

Bulb 194 is spaced with respect to igniter 20 so that igniter 20 must attain a temperature well above the ignition temperature of gas before the heat radiated to bulb 194 is sufficient to effect substantial thermal expansion of the liquid in bulb 194. When igniter 20 reaches such temperature, the liquid in bulb 194 expands, causing contacts 172 and 176 in switch 12 to open, and contacts 176 and 174 to close. When contacts 172 and 176 open, solenoid winding 78, controlling valve 66, is maintained energized through contacts 92, 94, and 90 of switch 14, and relay winding 208 is maintained energized, only momentarily, also through contacts 92, 94, and 90.

With contacts 176 and 174 closed, relay winding 220 is pulled in through its normally-closed relay contacts 232 and held in through its normally-open relay contacts 236 through circuitry previously described. Energizing of relay winding 220 also effects opening of normally-closed relay contacts 218. Relay winding 208 is de-energized, causing its controlled contacts 206 to open and effect de-energizing of the igniter 20. The mass of the igniter 20 is sufficient, however, to enable it to remain above the ignition temperature of gas for a short period of time after being de-energized.

Energizing of relay winding 220 also effects closing of normally-open relay contacts 238. This enables solenoid winding 148, which controls valve 136, to be energized by secondary winding 28 through thermostat 22, leads 210 and 228, contacts 92, 90, and 94 of pressure actuated switch 14, leads 214 and 212, contacts 176 and 174 of switch 12, solenoid winding 148, lead 242, contacts 238, and lead 222, and effect opening of valve 136.

Referring to FIG. 2, opening of valve 136 permits gas to flow to the lower diaphragm portion 116, increasing the pressure therein and causing valve 106 to be opened. Gas now flows to the burner 16 to be ignited by the igniter 20. When flame appears, bulb 194 is impinged by burner flame so that contacts 176 and 174 are maintained closed.

The pressure in lower diaphragm chamber portion 116 and consequently, the degree of opening of valve 106, will be regulated by regulator valve 160 to maintain a predetermined outlet pressure in outlet passage 50. Orifice 132 at the entrance of valve chamber 130 is sufficiently larger than the bleed-off orifice 154 at the entrance of regulator valve chamber 156 to maintain sufficient operating pressure in lower diaphragm chamber portion 116 when valve 136 is open, and limits the operating pressure to a range wherein the regulator valve 160 will operate accurately.

Under normal burner operation, burner 16 will continue to burn until thermostat 22 opens, whereupon electromagnetically operated valves 66 and 136 immediately close. When valves 66 and 136 close, the existing pressure in lower diaphragm chamber portion 116 exhausts to outlet passage 56 through passages 128, 150, and 152, orifice 154, chamber 156, and passage 158, permitting closure of valve 106 under the bias of spring 114.

For reasons to be later described, it is necessary when valves 66 and 136 close, that chamber 80 of pressure actuated switch 14 be exhausted to effect disconnecting of contacts 90 and 92 from movable contact 94. Since the only route for gas to exhaust from chamber 80 is past valve 106, it is necessary that valve 106 remain open for a sufficient period of time after the closing of valves 66 and 136 to enable this exhausting to occur. To provide such delay in closing valve 106, orifice 154 is made sufficiently small so as to delay the exhausting of lower diaphragm chamber 116 sufficiently to permit chamber 80 to exhaust past valve 106 before valve 106 closes.

If during normal burner operation the electrical power fails, valves 66 and 136 immediately close, causing all gas flow through valve device 10 to cease. With burner flame extinguished, bulb 194 begins to cool. Also, as described above, chamber 80 in pressure actuated switch 14 exhausts past valve 106 to effect opening of its contacts 90 and 92, and valve 106 subsequently closes. Also, relay winding 220 is de-energized, effecting opening of its relay contacts 236 and 238, and closing of its relay contacts 218 and 232.

If electrical power is restored before bulb 194 has cooled sufficiently to cause contacts 176 and 174 in switch 12 to open, valve 66 cannot be energized because there is no energizing circuit for solenoid winding 78 which controls valve 66. Specifically, contacts 90 and 92 in pressure actuated switch 14 are open, and contacts 172 and 176 in thermostatically actuated switch 12 are open. Relay winding 208 is also prevented from being energized due to open contacts 90 and 92 in switch 14 and open contacts 172 and 176 in switch 12, so that igniter 20 cannot be energized. Relay winding 220 is also prevented from being energized due to open contacts 90 and 92 in switch 14. The system remains in this inoperative mode until bulb 194 cools sufficiently to enable contacts 172 and 176 in switch 12 to close, at which time a normal burner operation, as previously described, is initiated.

If during normal burner operation the gas supply fails or drops below a predetermined pressure, contacts 90 and 92 in pressure actuated switch 14 open. This breaks the electrical circuits to solenoid windings 78 and 148, effecting the immediate closing of valves 66 and 136, respectively, and subsequent closing of valve 106. The circuit to relay winding 220 is also broken by the opening of contacts 90 and 92 so that its relay contacts 218 and 232 close and its relay contacts 236 and 238 open. Under these conditions, the burner flame goes out and bulb 194 begins to cool.

Contacts 90 and 92 cannot be re-closed until valve 66 is opened to allow gas to flow into chamber 80 of pressure actuated switch 14. Valve 66 cannot be opened until "cold" contacts 172 and 176 in switch 12 are closed. Relay winding 208, which controls energizing of igniter 20, cannot be energized until contacts 172 and 176 in switch 12 are closed, and relay winding 220 cannot be energized until contacts 90 and 92 in switch 14 and contacts 176 and 174 in switch 12 are closed. Therefore, the system remains in this inoperative mode until bulb 194 cools sufficiently to enable contacts 172 and 176 in switch 12 to close, at which time a normal burner operation is initiated.

Thus, in both an electrical power interruption or a gas pressure failure, pressure actuated switch 14 is effective to prevent a re-institution of gas flow until the igniter is again energized to ignite the gas. Under these conditions, no unburned gas can accumulate.

If for any reason other than an electrical power failure or a gas pressure failure ignition does not occur when contacts 176 and 174 in switch 12 close, or if ignition occurs but the burner flame is not properly sensed by bulb 194, the system will lock out. For example, a low supply voltage at power terminals 30 and 32 might cause the igniter 20 to eventually radiate sufficient heat to effect closing of contacts 176 and 174 but not be hot enough to ignite the gas; the ports on burner 16 might be clogged with dirt or other foreign matter and prevent ignition; the bulb 194 might be improperly positioned so as not to be impinged by the burner flame; or there may be large amounts of air in the gas supply. Under such conditions, the gas or air continues to flow until contacts 176 and 174 in switch 12 open.

The opening of contacts 176 and 174 in switch 12 breaks the energizing circuit to solenoid winding 148, effecting the closing of valve 136. With valve 136 closed, valve 106 closes and terminates the flow of gas to burner 16. Solenoid winding 78, controlling valve 66, remains energized due to contacts 90 and 92 in switch 14 remaining closed. Also, relay winding 220 remains energized due to contacts 90 and 92 remaining closed. With relay winding 220 energized, its relay contacts 218 controlling energizing of relay winding 208 remain open, so that relay contacts 206 remain open, preventing energizing of igniter 20. Under these lockout conditions, gas flow is terminated and the igniter is de-energized. As long as contacts 90 and 92 in switch 14 remain closed, this lock-out condition will be maintained. Thus, pressure actuated switch 14 is effective to prevent an automatic attempt at re-ignition so that a hazardous accumulation of unburned gas is prevented.

Although repeated attempts at ignition may be effected by removing the electrical power to solenoid winding 78 and relay winding 220 and then restoring it, such as by manually cycling the thermostat off and on, such a practice is strongly discouraged. That is to say, while the amount of gas that may flow while arriving at the lock-out condition is relatively small and poses no safety hazard, repeated unsuccessful attempts at ignition may cause a hazardous accumulation of unburned gas in the combustion chamber. Therefore, as with the lock-out function of other burner control systems, this lock-out condition should alert the homeowner to the fact that there is some type of system malfunction that must be corrected before repeated attempts to ignite are made.

While a preferred embodiment of the present invention has been illustrated and described in detail in the drawings and foregoing description, it will be recognized that many changes and modifications will occur to those skilled in the art. It is, therefore intended, by the appended claims, to cover any such changes and modifications as fall within the true spirit and scope of the invention.

We claim:

1. In a gas burner control system, a burner;

an electrical resistance igniter for igniting said burner;

a gas valve device including first and second valves connected fluidically in series;

a thermostatically actuated switch means including a switch having a cold contact position and a hot contact position, and including a temperature sensing portion;

said temperature sensing portion being positioned with respect to said igniter so as to cause said switch to be in said cold position when said igniter is below a predetermined temperature sufficient to ignite gas and in said hot position when said igniter is above said predetermined temperature, and being positioned with respect to said burner so as to be impinged by a burner flame for maintaining said switch in said hot position;

first circuit means including said switch in said cold position for effecting energizing of said igniter;

second circuit means including said switch in said cold position for effecting opening of said first valve;

a pressure actuated switch electrically connected in parallel with said thermostatically actuated switch in said cold position and in series with said thermostatically actuated switch in said hot position;

said pressure actuated switch being actuated to a closed contact position in response to gas pressure when said first valve is open for providing a hold-in circuit for maintaining said first valve open; and third circuit means including relay means, said thermostatically actuated switch in said hot position, and said pressure actuated switch in said closed contact position for effecting de-energizing of said igniter and for effecting opening of said second valve, said igniter having sufficient mass to remain above said predetermined temperature for a short time after being de-energized for effecting ignition of said burner.

2. The control system claimed in claim 1 wherein said relay means includes an electrical winding and a plurality of contacts, said electrical winding being initially energized through a first set of normally-closed contacts controlled by said electrical winding and thereafter maintained energized through a first set of normally-open contacts also controlled by said electrical winding, said relay means being so constructed that said normally-open contacts are closed before said normally-open contacts are opened.

3. The control system claimed in claim 2 wherein said first set of normally-closed contacts is in series with said thermostatically actuated switch in said hot position and said pressure actuated switch in said closed contact position, and said first set of normally-open contacts is in series only with said pressure actuated switch in said closed contact position whereby said electrical winding is maintained energized independent of said thermostatically actuated switch and dependent on said pressure actuated switch being in said closed contact position.

4. The control system claimed in claim 2 wherein said relay means includes a second set of normally-closed contacts for effecting de-energizing of said igniter when said electrical winding is energized.

5. The control system claimed in claim 2 wherein said relay means includes a second set of normally-open contacts for effecting opening of said second valve when said electrical winding is energized.

6. In a gas burner control system, a burner;

an electrical resistance igniter for igniting said burner;

first and second valves connected fluidically in series for controlling gas flow to said burner;

said first valve including a controlling electrical winding;

said second valve being a pressure operated valve located downstream from said first valve and defining a chamber therebetween;

a first expansible chamber operatively connected to and effective to open said second valve when sufficient gas pressure is applied thereto;

a first branch passageway leading from said chamber between said first and second valves to said first expansible chamber;

a third valve in said first branch passageway for controlling flow of gas to said first expansible chamber and including a controlling electrical winding;

a pressure actuated switch having an open contact position and a closed contact position;

a second expansible chamber located between said first and second valves and operatively connected to and effective to actuate said pressure actuated switch to its said closed contact position when exposed to a predetermined gas pressure;

a second branch passageway leading from said first expansible chamber to a point downstream from said second valve for exhausting said first expansible chamber when said first or said third valves close whereby said second valve is closed;

a thermostatically actuated switch having a cold position and a hot position;

a thermostatic actuator arranged to be heated by said igniter and operative when said igniter is above gas ignition temperature for moving said thermostatically actuated switch to its said hot position, and arranged to be subsequently heated by a flame from said burner for maintaining said thermostatically actuated switch in its said hot position;

first circuit means including said thermostatically actuated switch in its said cold position for effecting energizing of said igniter;

second circuit means including said thermostatically actuated switch in its said cold position for effecting energizing of said winding of said first valve for opening said first valve; and third circuit means energized when said thermostatically actuated switch is moved to its said hot position for effecting de-energizing of said igniter and for effecting energizing of said winding of said third valve for opening said third valve which effects opening of said second valve, said pressure actuated switch being electrically connected in parallel with said thermostatically actuated switch in its said cold position for maintaining said winding of said first valve energized.

7. The control system claimed in claim 6 including means for retarding said exhausting of said first expansible chamber to enable said second expansible chamber to exhaust past said second valve before said second valve closes, so that said pressure actuated switch is in its said open contact position whenever said first and second valves are closed.

8. The control system claimed in claim 7 wherein said means for retarding said exhausting includes restricting orifice means in said second branch passageway.

9. The control system claimed in claim 6 wherein said third circuit means includes a relay having a winding, a first set of normally-closed contacts for effecting initial energizing of said relay winding, a second set of normally-closed contacts for effecting de-energizing of said igniter, a first set of normally-open contacts for maintaining said relay winding energized, and a second set of normally-open contacts for effecting energizing of said winding of said third valve.

10. The control system claimed in claim 9 wherein said first set of normally-closed contacts and said relay winding are connected in series with said pressure actuated switch and said thermostatically actuated switch in its said hot position so that said initial energizing of said relay winding is effected only when said thermostatically actuated switch is in its said hot position whereby gas flow to said burner is initiated only when said igniter is above said gas ignition temperature.

11. The control system claimed in claim 10 wherein said relay is constructed so that said first set of normally-open contacts closes before said first set of normally-closed contacts open.

12. The control system claimed in claim 9 wherein said first set of normally-open contacts and said relay winding are connected in series with said pressure actuated switch and independent of said thermostatically actuated switch whereby said relay is maintained energized so as to maintain de-energizing of said igniter and thus prevent a second attempt to ignite said burner when, due to a failure of said igniter to ignite said burner, said thermostatically actuated switch returns to its said cold position.

* * * * *